United States Patent [19]

Sato

[11] Patent Number: 4,783,937

[45] Date of Patent: Nov. 15, 1988

[54] DEVICE FOR SUPPRESSING VIBRATION OF STRUCTURE

[75] Inventor: Takanori Sato, Tokyo, Japan

[73] Assignee: Shimizu Construction Co., Ltd., Tokyo, Japan

[21] Appl. No.: 42,365

[22] Filed: Apr. 24, 1987

[30] Foreign Application Priority Data

| | | | |
|---|---|---|---|
| Aug. 6, 1986 | [JP] | Japan | 61-184922 |
| Aug. 6, 1986 | [JP] | Japan | 61-184923 |
| Nov. 26, 1986 | [JP] | Japan | 61-281184 |
| Nov. 28, 1986 | [JP] | Japan | 61-283485 |
| Jan. 23, 1987 | [JP] | Japan | 62-13368 |
| Jan. 23, 1987 | [JP] | Japan | 62-13369 |

[51] Int. Cl.[4] ..... E04B 1/92

[52] U.S. Cl. ..... 52/168; 52/167

[58] Field of Search ..... 52/167, 168, 245, 192

[56] References Cited

U.S. PATENT DOCUMENTS

| | | | |
|---|---|---|---|
| 4,226,554 | 10/1980 | Vandiver et al. | 52/168 X |
| 4,267,676 | 5/1981 | Marchaj | 52/167 |
| 4,514,942 | 5/1985 | Pocanschi | 52/107 |

*Primary Examiner*—Carl D. Friedman
*Assistant Examiner*—Creighton Smith
*Attorney, Agent, or Firm*—Hoffmann & Baron

[57] ABSTRACT

A device for suppressing vibration of a structure such as buildings and bridges, including a tank, disposed in the structure, for receiving a liquid for suppressing vibration of the structure, the tank being adapted to contain such an amount of the liquid that the liquid is equal in natural period to the structure.

27 Claims, 13 Drawing Sheets

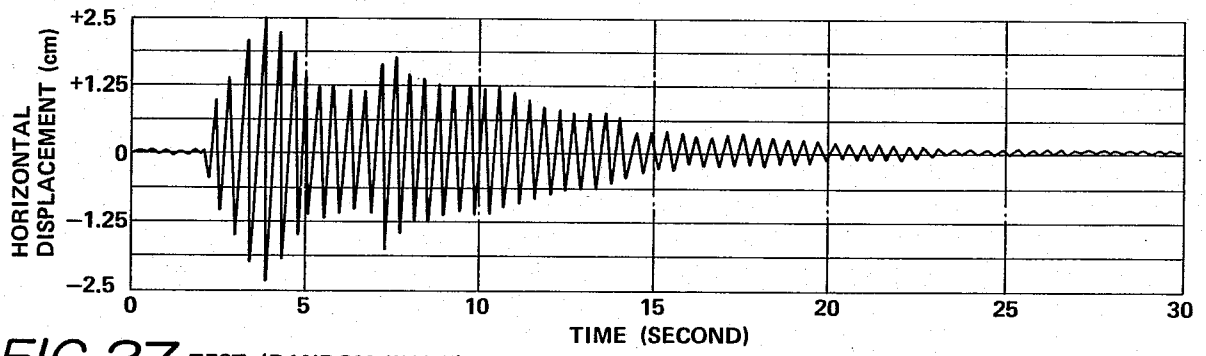
FIG.26 COMPARATIVE TEST (RANDOM WAVE)
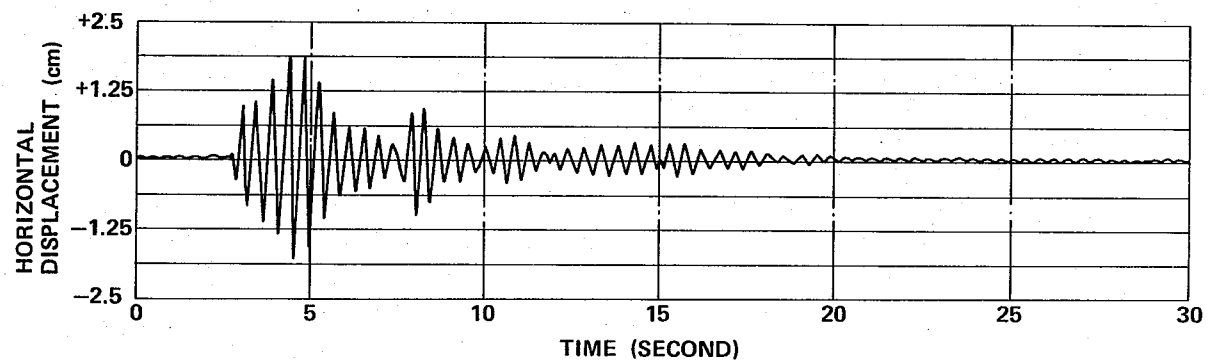
FIG.27 TEST (RANDOM WAVE)

DEVICE FOR SUPPRESSING VIBRATION OF STRUCTURE

BACKGROUND OF THE INVENTION

The present invention relates to a device for suppressing vibration of a structure, such as buildings and bridges, the vibration being caused by wind, earthquake or the like.

With recent developments of high strength materials and rapid progress in both manufacturing engineering and computer structure analysis, highrise structures become lightweight and flexible. Such lightweight and flexible highrise structures have a tendency that the natural frequency and vibration damping factor thereof become small, and hence there is a possibility that various kinds of vibration unexpectedly occur with a large amplitude due to external forces caused by earthquake or wind. Thus, such vibration of these structures can give uneasiness to occupants and further, there is a possibility of providing stress beyond an allowable limit to the structure.

Accordingly, it is an object of the present invention to provide a device for effectively suppressing vibration, caused by wind, earthquake, etc, of a structure in an economic way.

SUMMARY OF THE PRESENT INVENTION

With this and other objects in view, the present invention provides a device for suppressing vibration of a structure, comprising: a tank, disposed in the structure, for receiving a liquid for suppressing vibration of the structure, the tank being adapted to contain such an amount of the liquid that the liquid is equal in natural period to the structure.

BRIEF DESCRIPTION OF THE DRAWINGS

The invention will now be described by way of example with reference to the accompanying drawings in which:

FIG. 26 is a graph of a comparative test on the model in FIG. 25, in which no vibration suppressing water was used; and FIG. 27 is a graph of a test conducted on the model, in which vibration suppressing water was used.

DETAILED DESCRIPTION OF THE PREFERRED EMBODIMENTS

Figure 1:
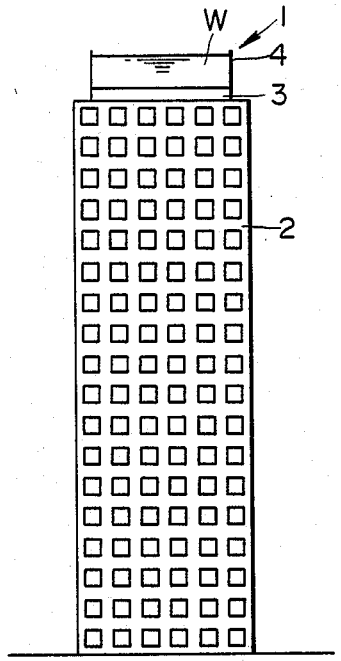
FIG. 1 is a diagrammatic front view of a building with a vibration suppressing device, according to the present invention, placed on its rooftop, the device being illustrated in a vertical section.
Figure 2:
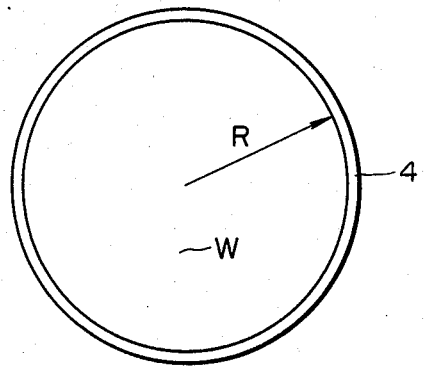
FIG. 2 is an enlarged plan view of the vibration suppressing device in FIG. 1.
Figure 3:
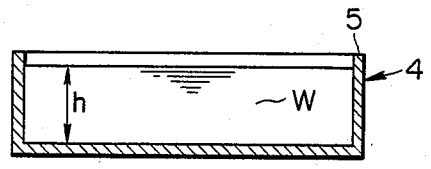
FIG. 3 is an axial cross-section of the vibration suppressing device in FIG. 2.

Referring now to FIGS. 1 to 3, a vibration suppressing device 1, constructed according to the present invention, is preferably installed on the rooftop of a building 2 through a conventional vibration insulation base 3 which has resilient plates and steel plates alternatively stacked. The vibration suppressing device 1 includes a hollow cylindrical tank 4 mounted on the supporting base 3, the tank 4 having an upper open end 5. The vibration suppressing device 1 is preferably disposed on the rooftop of the building 2 for efficiently suppressing vibration thereof caused by earthquake, wind, etc. The tank 4 may be used also for containing drinking water or fire water.

Figure 4:
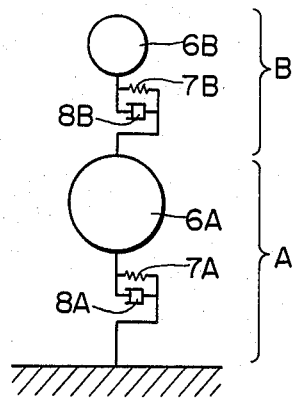
FIG. 4 illustrates a diagrammatic model of the building with the vibration suppressing device in FIG. 1.

The tank 4 is designed to contain such an amount of liquid W that the liquid W is equal in natural period to the building 2 for suppressing vibration of the building. In principle, the building 2 and the vibration suppressing device 1 exhibit vibration properties which may be approximate to the vibration property of a vibration model shown in FIG. 4. the vibration model is composed of a first vibration system A, which represents the building 2, and a second vibration system B which is a vibration model of the liquid W in the tank 4, the second vibration system B connected serially to the first vibration system A. The first vibration system A includes an first body 6A of mass Mo, a first spring 7A, which has a spring constant Ko and supports the first body 6A, and a first dashpot 8A having a damping factor ho and added in parallel with the first spring 7A. The second vibration system B has a second body 6B with mass M1, a second spring 7B, which has a spring constant K1 and supports the second body 6B, and a second dashpot 8B having a damping factor hl and added in parallel with the second spring 7B.

When the vibration system A is forced by an outer force exerted to the body 6A, to vibrate, the vibration system B begins to vibrate with a phase shifted $\frac{1}{4}$ of the vibration period of the first vibration system A. The vibration of the first vibration system A may be suppressed by making both the vibration systems A and B equal in period. The period Ti of a vibration system i is generally given by the equation (1):

$$Ti = 2\pi\sqrt{\frac{Mi}{Ki}} \tag{1}$$

where Mi is the mass of the vibration system i and Ki is the spring constant. Since the period To of the building 2 is thus defined by both its mass Mo and spring constant Ko, the period Tl of the liquid W may be made equal to the period To by appropriately selecting the size and volume of the tank 4.

According to Housner theory, the effective mass Ml, which functions as a vibrating body, of liquid W movable in the tank 4 is given by the following equation (2):

$$Ml = \frac{1}{4}\left(\frac{5}{6}\right)^2 \frac{27}{8} \cdot \frac{\tanh\sqrt{\frac{27}{8}}}{\sqrt{\frac{27}{8}} \cdot \frac{h}{R}} \cdot M \tag{2}$$

where h is the height from the bottom of the tank 4 to the level of the liquid, R a radius of the tank 4, and M the mass of the liquid W contained in the tank 4. (see "Dynamic Pressures on Accelerated Fluid Containers" by Housner, G. W., Bullitin of the Seismological Society of America, vol. 47(1957), pp. 15–35)

The natural frequency $\omega$ of the liquid W, i.e., natural frequency of sloshing, is given by the equation (3):

$$\omega^2 = \frac{h}{R} \cdot \sqrt{\frac{27}{8}} \cdot \tanh\left(\sqrt{\frac{27}{8}} \cdot \frac{h}{R}\right) \tag{3}$$

The natural period T of the liquid is thus obtained by the equation (4):

$$T = 2\pi/\omega \tag{4}$$

When R=15 m, h=2 m and M=1414 metric tons (Ml=812 metric tons from the equation (2)), the period Tl=11.7 seconds.

The ratio of the effective mass Ml of the liquid W over the mass Mo of the building is typically:

Ml/Mo=about 1/50 to about 1/200

Below the lower limit or about 1/200, vibration suppressing effect cannot be efficiently obtained while above the upper limit or about 1/50, the weight of the liquid will provide a considerable influence to the structural design of the building, thus making it necessary to amend the structural design. The lower limit is preferably about 1/100. However, the suppressing effect may be obtained even at about Ml/Mo=about 1/300.

When a closed tank is fully charged with the liquid W so that the liquid is stationary and no waves are hence produced during vibration, the equation (2) is replaced by the following equation:

$$Ml = M \cdot \frac{\tanh\left(\sqrt{3} \cdot \frac{h}{R}\right)}{\sqrt{3} \cdot \frac{h}{R}} \tag{2'}$$

Figure 5:
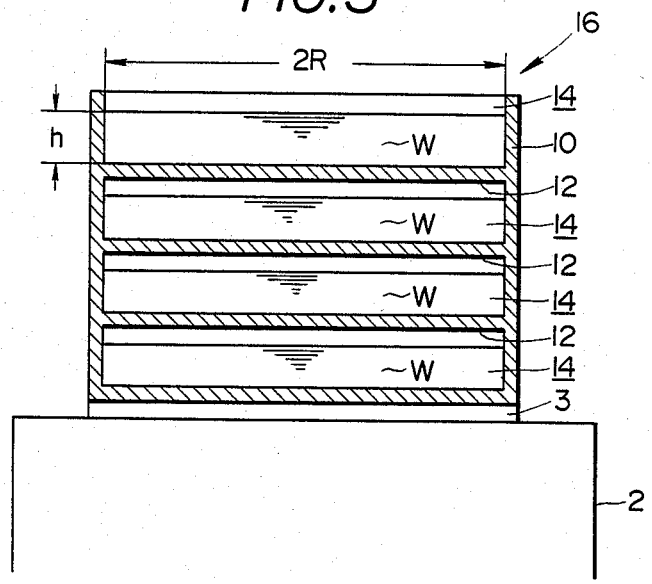
FIG. 5 is an axial view of another embodiment of the present invention.
Figure 6:
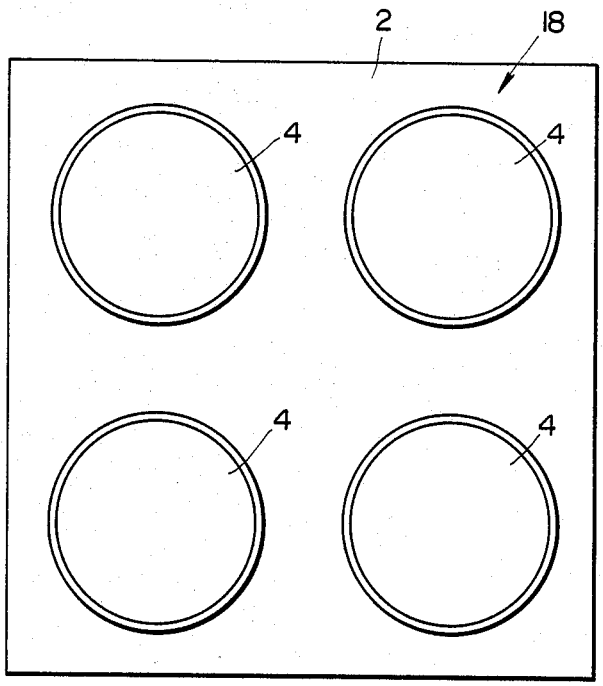
FIG. 6 is a plan view of a modified form of the vibration suppressing device in FIG. 1.

FIGS. 5 and 6 illustrate another embodiment of the present invention in which a cylindrical tank 10 is horizontally partitioned with partition walls 12 into a plurality of, four in this embodiment, horizontal chambers 14. In this vibration suppressing device 16, the number of chambers 14 in which is contained the liquid W changes the effective mass of the liquid W without changing the period of the liquid W since the latter is defined by both the radius R of the chambers 14 and height h of the liquid W. Thus, the performance of vibration suppressing of the device 16 may be adjusted by changing the number of chambers 14 used.

A modified form 18 of the vibration suppressing device in FIGS. 1–3 is illustrated in FIG. 6 and is distinct from it in that four tanks 4 are installed on the rooftop of the building 2. The four tanks 4 are designed to contain water so that the water may be equal in natural period to the building 2. The performance of vibration suppressing of the device 18 may be also adjusted by appropriately setting the effective mass of water. This may be made by selecting number of tanks 4 in which water is contained.

Figure 7:
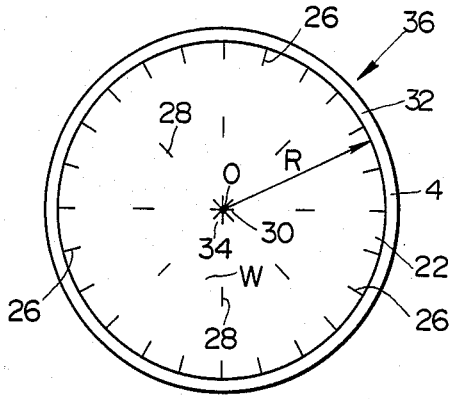
FIG. 7 is a plan view of another modified form of the vibration suppressing device in FIG. 1.
Figure 8:
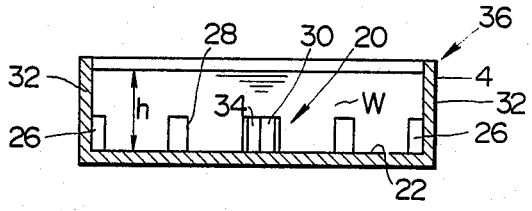
FIG. 8 is an axial section of the vibration suppressing device in FIG. 7.

FIGS. 7 and 8 illustrate another modified form of the vibration suppressing device 1 in FIG. 1, from which it is distinct in that it is provided with a baffling mechanism 20 at the bottom 22 of the tank 4 for adjusting the damping factor of the liquid W. This mechanism 20 includes 24 rectangular peripheral baffleplates 26, 8 rectangular intermediate baffleplates 28 and a center baffle member 30. The peripheral baffleplates 26 are radially arranged at regular angular intervals about the center 0 of tank 4. Each of the peripheral baffleplates 26 is attached at its one vertical edge to the inner face of the peripheral wall 32 of the tank 4 and at its lower end to the upper face of the bottom wall 22 thereof. The intermediate baffleplates 28 are also radially arranged and at regular angular intervals. They are attached at their bottom ends to the upper face of the bottom wall 22. The center baffle member 30 has eight rectangular plates 34 arranged to extend radially from the center 0 of the tank 4, each rectangular plate 34 being attached at its one vertical edge to the other rectangular plates 34 and at its lower end to the upper face of the bottom 22 of the tank. The center, intermediate and peripheral baffle members 30, 28 and 26 are each designed to have a height below the level h of the liquid W.

When the building 2 is forced to swing about the center of its rigidity by wind or the like due to the difference between the center of gravity and the center of rigidity of the building 2 to produce a circumferential flow of the liquid, the baffling mechanism 20 provides a resistance to the liquid flow. Thus, the liquid W suppresses the swing of the building 2 since it flows at a period equal to the period of the swinging of the building 2 with a shifted phase. The vibration suppressing device 36 is capable of suppressing the swinging of the building about both the vertical and horizontal axes. The baffling mechanism 20 adjusts the damping factor of the liquid W by selecting the size and number of baffling members 26, 28 and 30, thus being capable of appropriately adjusting the damping factor of the building. From simulation tests it is believed that radial length of the baffling members 26, 28, 30 is about 5 cm for 30 m diameter tank 4.

Figure 9:
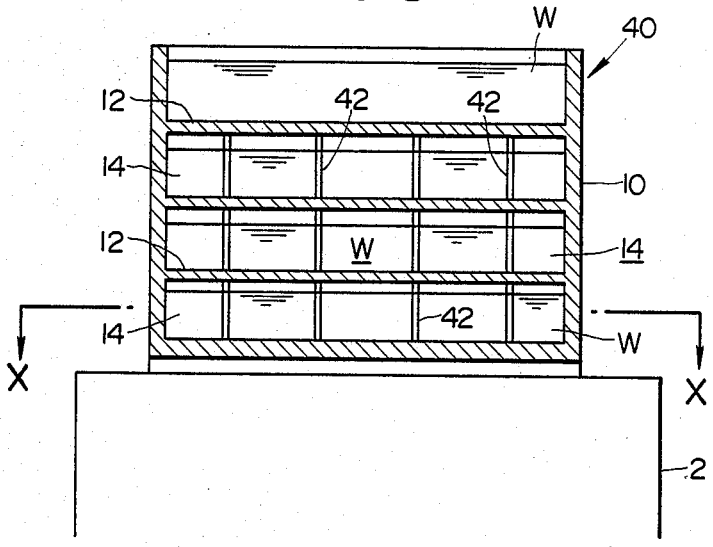
FIG. 9 is an axial cross-section of a modified form of the device is FIG. 5.
Figure 10:
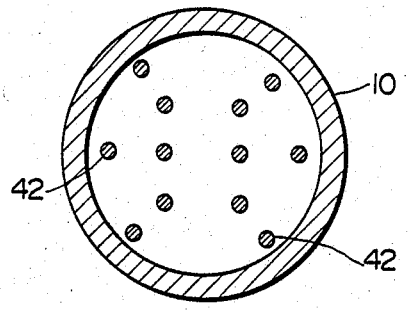
FIG. 10 is a sectional view in a modified scale, taken along the line X—X in FIG. 9.

A modified form of the vibration suppressing device in FIG. 5 is shown in FIGS. 9 and 10. In this modified device 40, a plurality of baffling poles 42 are mounted to the tank 10 to connect adjacent bottom walls 12 of each chamber. The baffling poles 42 serve both to provide flowing resistance to the liquid W and to support the bottom walls 12 of upper chambers 14.

Figure 11:
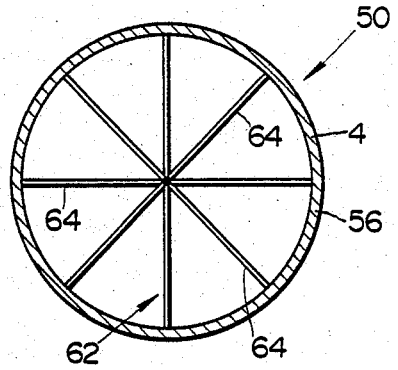
FIG. 11 is a sectional view of another modified form of the device in FIG. 1, taken along the line XI—XI in FIG. 13.
Figure 14:
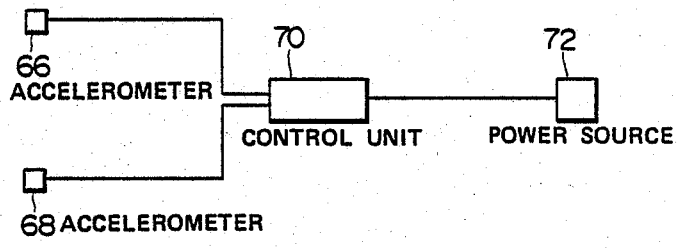
FIG. 14 is a block diagram of the baffling member controlling system of the device in FIG. 11.
Figure 12:
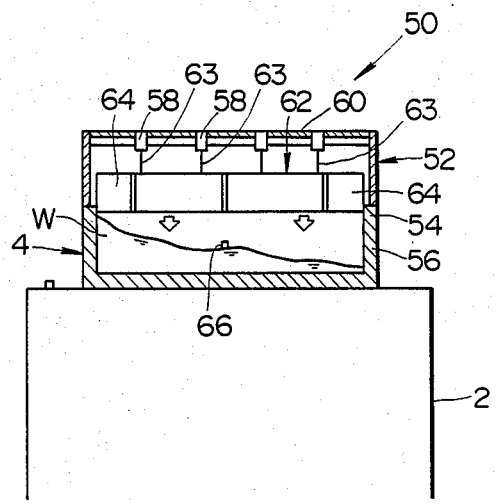
FIG. 12 is an axial section of the device in FIG. 11, with the partition member raised.
Figure 13:
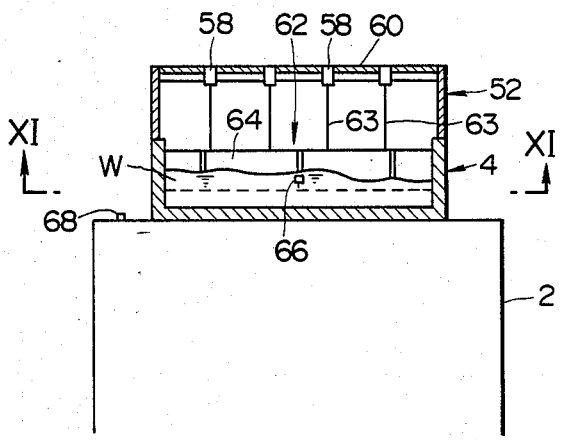
FIG. 13 is an axial section of the device in FIG. 11, with the partition member lowered.
Figure 15:
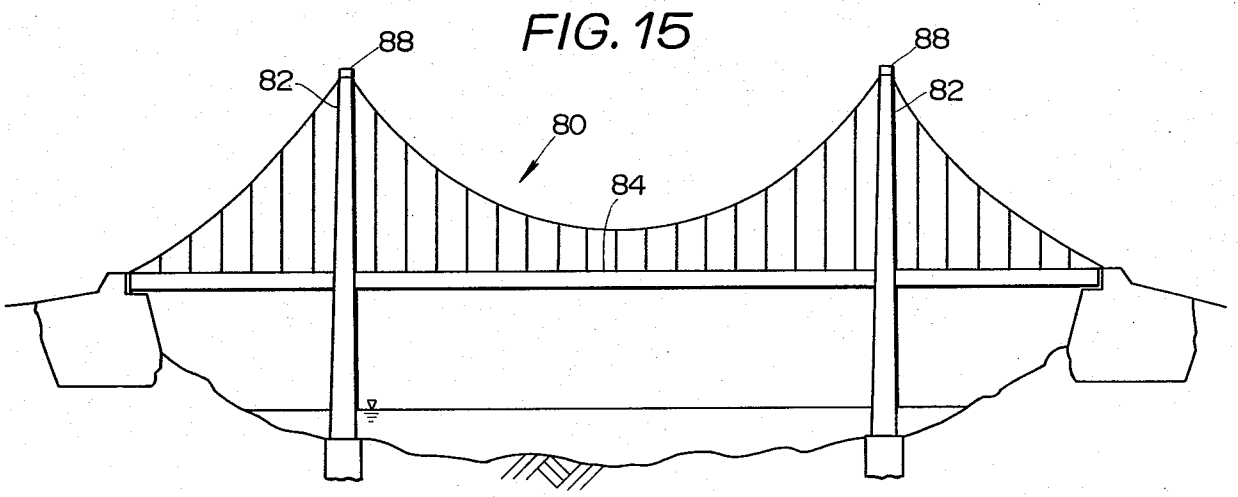
FIG. 15 is a side view of a suspension bridge with vibration suppressing devices according to the present invention.
Figure 16:
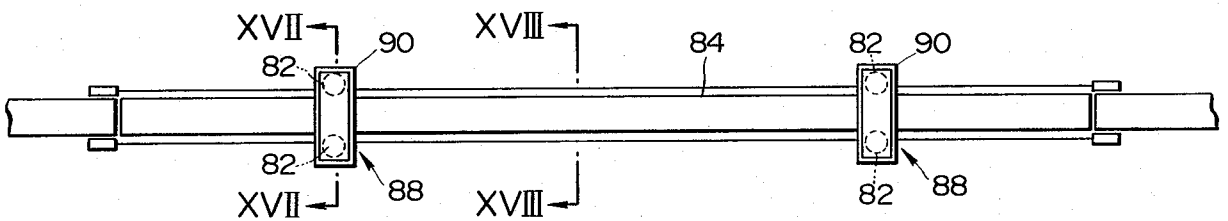
FIG. 16 is a plan view of the suspension bridge in FIG. 15 with essential portions modified in scale.
Figure 17:
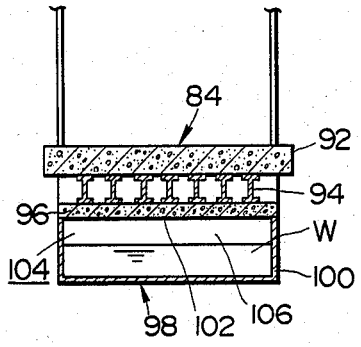
FIG. 17 is an enlarged view taken along the line XVII—XVII in FIG. 16.
Figure 18:
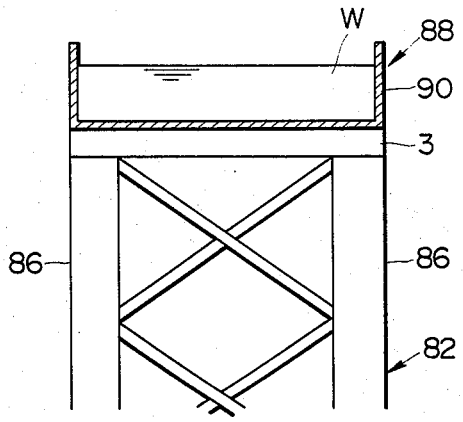
FIG. 18 an enlarged vertical section of the device mounted on the top of one tower of the bridge in FIG. 15.

FIGS. 11 to 13 illustrate another modified form of the vibration suppressing device in FIGS. 1 to 3. When the liquid W in the tank 4 makes resonance to a dominant frequency component of various oscillatory waves in the building 2, the surface of the liquid may make an excessively large amplitude of vibration which is called the sloshing phenomenon. This modified vibration suppressing device 50 serves to suppress such a sloshing phenomenon. The tank 4 has a hollow cylindrical closure member 52 coaxially mounted on the upper edge 54 of the circumferential wall 56 to cover it. A plurality of electric hoists 58 are mounted on the ceiling 60 of the closure member 52 for vertically moving a baffling or partitioning member 62 through wires 63. The partitioning member 62 has eight rectilinear partition plates 64 each attached at one end to the other partition plates 64 so that they extend radially outwards although it may have other shapes suitable for suppressing sloshing of the liquid W. The partitioning member 62 is designed to be received in the tank 4 when lowered. An accelerometer 66 is mounted to the inner face of the circumferential wall 56 of the tank 4 at a level below the normal water surface of liquid W for determining the acceleration of the liquid which is forced to vibrate by vibration of the building 2. Another accelerometer 68 is provided on the rooftop of the building 2 around the tank 4. These accelerometers 66 and 68 are electrically connected through a conventional electronic control unit 70 to a power source 72 of the electric hoists 58 for controlling the operation of the electric hoists. In practice, the partition member 62 is horizontally locked by placing the lower end thereof into the tank 4 for preventing lateral swing thereof. Any conventional electric locking mechanism which is electrically controlled by the control unit 70 may be provided to the closure member 52 for normally locking the partition member 62 and for releasing it when the sloshing phenomenon is detected.

When the liquid W in the tank 4 is about to make resonance with the building 2, data, representing acceleration caused, are transmitted from the accelerometers 66 and 68 to the control unit, where coincidence of the both data is detected, so that the electric hoists 58 are instantaneously supplied with current from the power source 72. The electric hoists 58 are thus actuated to lower the partition member 62 into the liquid W, with the result that vibration of the liquid W is suppressed with the partition member 62 and thereby any excessively large amplitude of vibration of the liquid face due to sloshing may be prevented.

In FIGS. 15–18, the present invention is applied to a suspension bridge 80 having two pairs of parallel towers 82 and reinforced girders 84 spanning between the tower pairs and between the land and the corresponding tower pair. Towers 82 of each pair have each the insulation base 3 mounted on their tops 86. A vibration suppressing device 88 including rectilinear box-shaped tank 90 is mounted on each insulation base 3. Each reinforced girder 84 includes floor 92, parallel supporting beams 94 and slab 96. The slab 96 also has another vibration suppressing device 98 including a tank 100 mounted to its lower face 102 to extend longitudinally and suspend from it, the tank 100 having a rectangular cross-section. The tank 100 is partitioned into a number of chambers 104 with a plurality of vertical partition walls 106, only one of which is illustrated. The partitioned chambers 104 facilitate the maintenance of the tank 100 and prevent the whole liquid W in them from flowing outside when one of the walls thereof is broken by wind or earthquake. Further, arrangement of the partition walls 106 enables appropriate adjustment of the damping factor of the liquid W.

The tanks 90 and the tank 100 are each designed to contain such an amount of liquid W so that the liquid W is equal in natural period to the corresponding towers 82 and reinforced girders 84, respectively. The vibration suppressing devices 88 and 98 serve to suppress lateral vibration of the towers 82 and the reinforced girders 84, respectively. Each of the vibration suppressing devices 88 and 98 may be also illustrated as a model in FIG. 4.

The behaviour of liquid W contained in the tanks 90 and 100 is analysed below. The relationship between the jth order of the natural period Tj and the jth order of the natural frequency ωj of sloshing is defined below.

$$Tj=2\pi/\omega j \tag{5}$$

The j is given by $$\omega j = \sqrt{kj \cdot g \cdot \tanh(kj \cdot H)} \tag{6}$$

where h is the depth of the liquid W in each tank 90, 100, g is gravitational acceleration. The kj in the equation (6) is given by the equation:

$$kj=(2j-1)\pi/2a \tag{7}$$

where $2a$ is the width, in the direction of the vibration, of the tank 90, 100. From the equations (5) to (7), the natural period Tj of the sloshing is obtained. The natural period of the first order sloshing is used for the embodiments. The ratio of the effective mass of the liquid W used over the mass of the corresponding towers 82 and 82 is equal to the ratio given in the preceding embodiments. The ratio of the effective mass of the liquid W to the corresponding reinforced girder 84 is also equal to the ratio already given.

Figure 19:
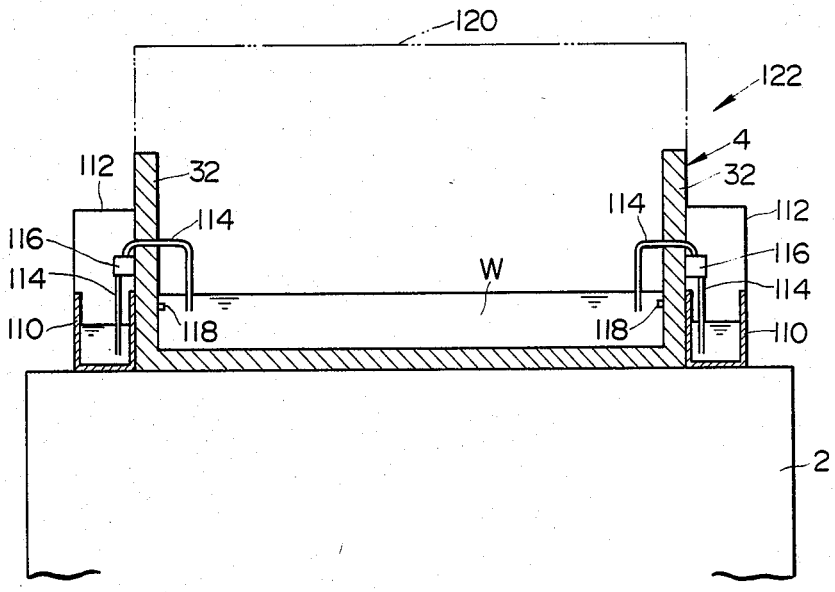
FIG. 19 is a vertical section of another modified form of the device in FIG. 1.

Another modified form of the vibration suppressing device in FIGS. 1–3 is shown in FIG. 19, in which a pair of auxiliary tanks 110 and 110 are mounted at diametrically opposed side positions of the tank 4. Each auxiliary tank 110 is provided with a closure cover 112 for covering the upper open end. The tank 4 and each of the auxiliary tanks 110 are communicated through a plumbing pipe 114 which passes through the circumferential wall 32 of the tank 4 at a level above the normal level of the liquid W. Each plumbing pipe 114 is provided with a pump 116 for supplying liquid from the auxiliary tank 110 to the tank 4 and for draining liquid W in the tank 4. The tank 4 has liquid level detectors 118, 118 mounted to the inner face of the circumferential wall 32 for detecting the normal level of the liquid W in the tank 4, at which normal level the liquid W has a necessary effective mass for suppressing vibration of the building 2. The liquid level detectors 118 are electrically connected to an electric control unit (not shown) which controls the pump 116. The electric control unit is constructed to actuate the pump 116 only when the liquid level detectors 118 detect that the water level is higher or lower than the normal level for a predetermined time period since wave troughs of the liquid W may reach to a level below the detectors 118, 118 in suppressing the vibration of the building 2. The tank 4 may be closed at its upper open end with a closure cover 120 shown by the dot-and-dash line in FIG. 19 for keeping the change in the liquid level as little as possible.

When the amount of the liquid W in the tank 4 increases due to rain or decreases due to evaporation, the variation of the liquid level is detected by the liquid level detector 118, which then provides an electric signal to the control unit for actuating the pumps 116, so that liquid is drained or supplied through the pipes 114 to keep the liquid W to the predetermined level. The amount of liquid W contained in the auxiliary tanks 110, 110 are set not to provide any adverse effect to the vibration suppressing effect of this vibration suppressing device 122. The pipes 114, 114 may be connected to a city water terminal pipe for receiving water as the vibration suppressing liquid W without providing the auxiliary tanks 110, 110.

Figure 20:
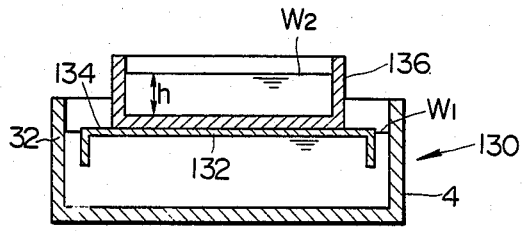
FIG. 20 is a still another modification of the device in FIG. 1.
Figure 21:
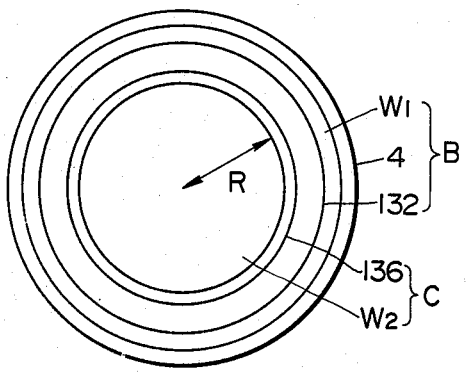
FIG. 21 is a plan view of the device in FIG. 20.
Figure 22:
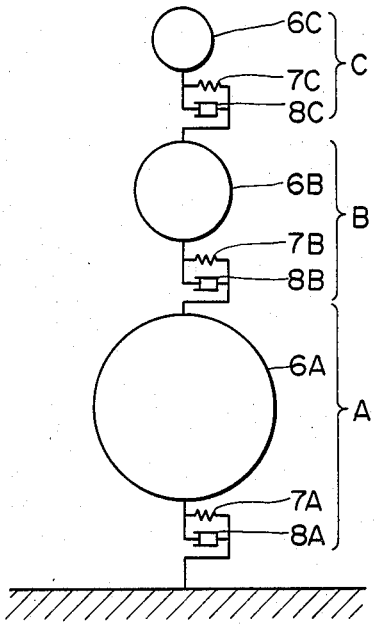
FIG. 22 is a diagrammatic view of a model of a building with the device in FIG. 20.

FIGS. 20 and 21 illustrates a further modified form of the vibration suppressing device in FIGS. 1–3. When the building 2 becomes smaller in vibration amplitude than the liquid W after the vibration of the former is considerably suppressed, the vibration suppressing device 1 in FIGS. 1–3 can function as a vibrator which provides further vibration to the building 2. This modified vibration suppressing device 130 serves to damp vibration of the liquid W in tank 4. A floating tray 132 is placed on the liquid W1 to float with its bottom 134 directed upwards. A second tank 136 is mounted on the floating tray 132 and contains liquid W2 which serves as a third vibration system C which is illustrated as a model in FIG. 22. This third vibration system C is serially connected to the second vibration system B and includes a third body 6C which represents liquid W2, a third spring 7C and a third dashpot 8C connected in parallel to the spring 7C. The third body 6C is connected through both the third spring 7C and the third dashpot 8C to the second body 6B. The theory previously described in relation to the first and the second vibration systems A and B may be applied to the third vibration system C. That is, the third vibration system C suppresses vibration of the second vibration system B in the same manner as the the second vibration system B which suppresses vibration of the first vibration system A. The ratio of the effective mass M2 of the liquid W2 over the effective mass of the liquid W1 is typically about 1/50 to about 1/200. A suitable member may be provided to the circumferential wall 32 of the tank 4 to keep the floating tray 132 away from it.

Figure 23:
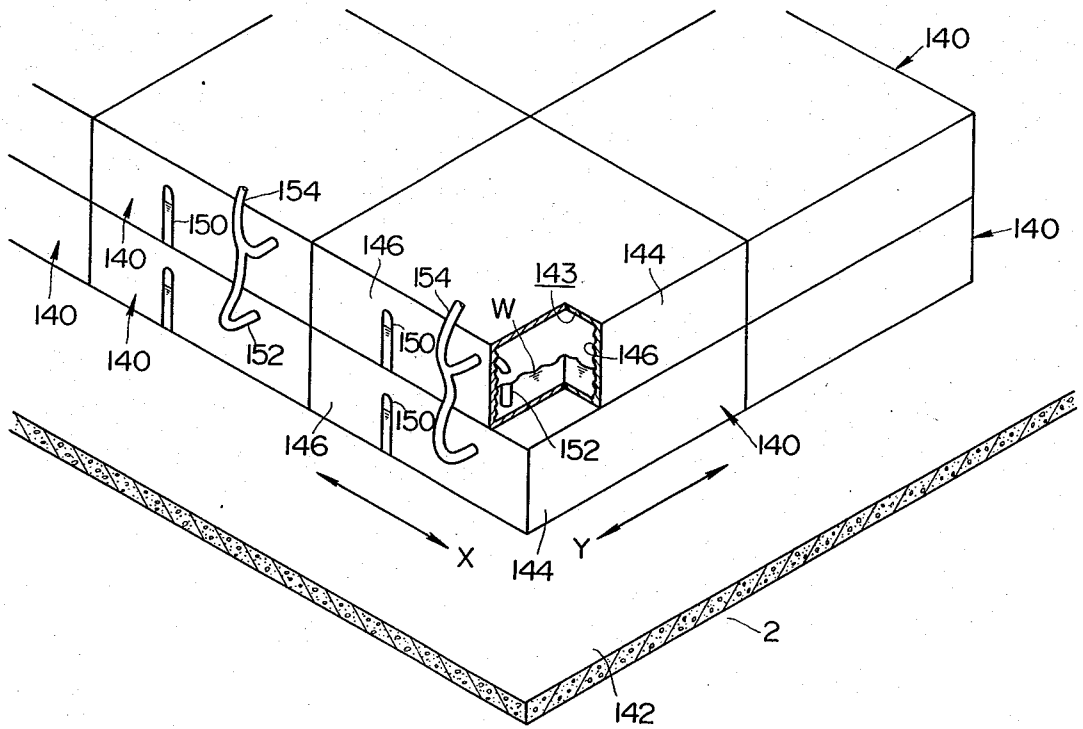
FIG. 23 is a perspective view, partly cut away, of another embodiment of the present invention.
Figure 24:
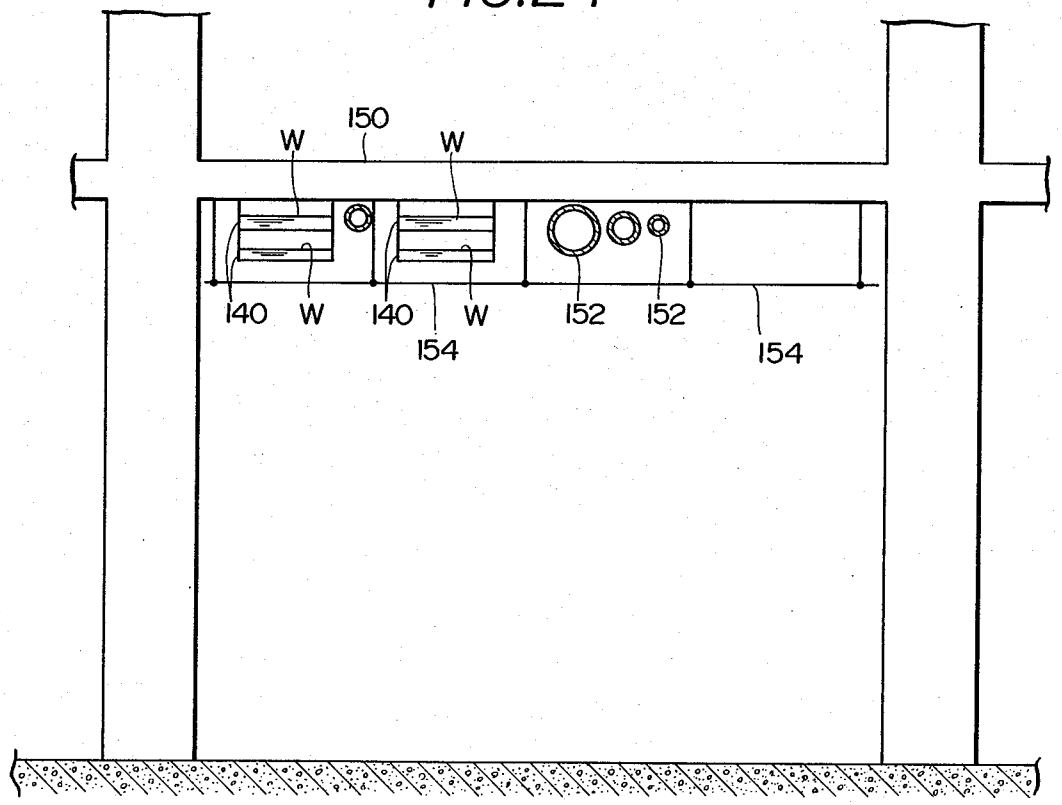
FIG. 24 is an illustration of vibration suppressing devices in FIG. 23 mounted on a ceiling of a building.

Another modified form of the vibration suppressing device in FIGS. 1–3 is illustrated in FIGS. 23 and 24, in which pairs of vertically stacked, closed rectilinear portable tanks 140 are disposed on a floor 142 of a building 2 in a column and row arrangement, adjacent tanks 140 at an equal level being placed end-to-end. The tanks 140 are made of a synthetic resin material. Each tank 140 is provided at inner faces 143 of its side walls 144 with irregularity 146 for increasing resistance of the inner faces 143 to the liquid W to adjust the damping factor of the latter and it is further provided at its one side wall 146 with a level gauge 150 made of transparent material such as a glass. A branch tube 152 of a manifold 154 passes through the one side wall 146 of each tank 140 and reaches near the bottom for supplying or draining water W. The manifold is communicated to a single water source through a pump (both not shown), thus enabling the level of the liquid W in the tanks to be equal or be adjusted.

The amount of the liquid W in the tanks 140 is adjusted so that the natural period of the liquid W is equal to that of the building 2 in each of the longitudinal direction X and the cross direction Y of the tanks. The whole amount of liquid in the tanks are adjusted typically to be about 1/50 to 1/200 of the mass of the building 2. The behavior of the liquid W in the tanks 140 may be analysed in the same manner as described in connection with the equations (5) to (7). The tanks 140 of this modification facilitate transportation, installation and replacement thereof.

Although in this modified form the tanks 140 are arranged in columns and rows, they are not restricted to this arrangement. They may be disposed away from each other on the floor or may be suspended from the ceiling 150 of the building 2 as illustrated in FIG. 24. Reference numerals 152 and 154 designate ducts and ceiling panels covering the ceiling.

In the preceding embodiments, tanks are hollow cylinders or rectilinear boxes, but them may be spherical, spheroidal or like configuration. The shape of the tanks may be changed according to tank-installation conditions. the natural period and the effective mass of the liquid W may be determined by equations, based on Housner theory, according to the shape of the tank.

In tanks, a predetermined amount of the liquid W is not necessarily stored in it always. The amount of the liquid W may be increased to the predetermined effective mass according to weather conditions.

Conventional rust preventive may be added in the liquid in the tank for preventing corrosion thereof.. Other liquids such as oil may be used as the liquid W. Oil prevents corrosion of tanks when they are made of, for example, a steel. The vibration damping factor of the vibration suppressing devices may be adjusted by using liquids which are different in viscosity coefficient from water.

Figure 25:
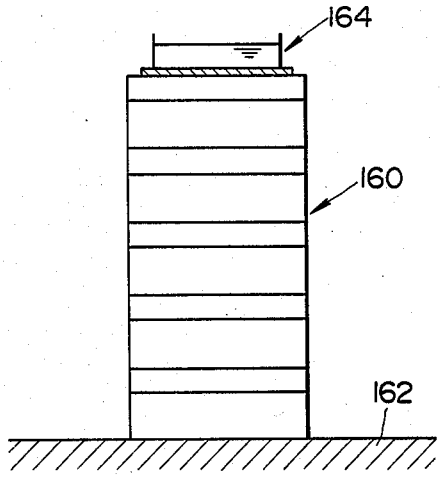
FIG. 25 is a diagrammatic illustration of a model used in experimental tests.

A 2 m high five-story building model 160 with a 100 cm×100 cm horizontal cross-section was constructed on a shaking table 162 as diagrammatically illustrated in FIG. 25, each story having a weight of 400 kg. The first order natural period To of the building model 160 was 0.41 second. A two-horizontal-chamber tank 164 as illustrated in FIG. 5 (although the tank 10 has four horizontal chambers 14 in FIG. 5) was mounted on the rooftop of the building model 160 and then water 46 kg in weight was poured into the tank 164 with equal level in each horizontal chamber 14. Each chamber 14 of the tank was 80 cm wide, 90 cm long and 3.2 cm deep in its inner size. The natural period Tl of the water was equal to that of the building model 160. Random waves (EL-CENTRO-NS waves) with maximum acceleration of 220 gal were applied to this building model 160. The relation, obtained from this test, between responded horizontal displacement of the forth story of the building model 160 and time is plotted in FIG. 27. On the other hand, a comparative test was carried out in which same random waves with maximum acceleration of 200 gal were applied to the building model 160 with the water removed from the tank 164. The results of the comparative test with respect to the fourth story are plotted in FIG. 26. From the results of both tests it is apparent that vibration of the building model was suppressed to a large degree in the test according to the present invention as compared to in the comparative test.

What is claimed is:

1. A device for suppressing vibration of a structure, comprising:

a first tank, disposed in the structure, for receiving a first liquid for suppressing vibration of the structure, the first tank being adapted to contain such an amount of the first liquid that the first liquid is equal in natural period to the structure, said first tank being adapted to contain such an amount of the first liquid that a ratio of effective mass of the first liquid over mass of the structure is about 1/50 to about 1/300, the structure having a center of rigidity and the first tank having an inner face; and first baffling means, mounted to the inner face of the first tank, for baffling a flow of the first liquid so as to suppress the swinging of the structure, the flow being caused due to swinging of the structure about the center of rigidity.

2. A device as recited in claim 1, which further comprises a horizontal partition wall horizontally partitioning the first tank to define two chambers, each chamber being adapted to contain such an amount of the first liquid that the first liquid is equal in natural period to the structure.

3. A device as recited in claim 2, wherein the first tank having a bottom, and the first baffling means comprises a plurality of supporting members erected on the bottom of the first tank for supporting the horizontal partition wall.

4. A device for suppressing vibration of a structure, comprising:

a first tank, disposed in the structure, for receiving a first liquid for suppressing vibration of the structure, the first tank being adapted to contain such an amount of the first liquid that the first liquid is equal in natural period to the structure, said first tank being adapted to contain such an amount of the first liquid that a ratio of effective mass of the first liquid over mass of the structure is about 1/50 to about 1/300; and a horizontal partition wall horizontally partitioning first tank to define two chambers, each chamber being adapted to contain such an amount of the first liquid that the first liquid is equal in natural period to the structure.

5. A device as recited in claim 4, wherein the first tank has a bottom, and wherein the first baffling means comprises a plurality of supporting members erected on the bottom of the first tank for supporting the horizontal partition wall.

6. A device for suppressing vibration of a structure, comprising:

a first tank, disposed in the structure, for receiving a first liquid for suppressing vibration of the structure, the first tank being adapted to contain such an amount of the first liquid that the first liquid is equal in natural period to the structure, the first tank being adapted to contain such an amount of the first liquid that a ratio of effective mass of the first liquid over mass of the structure is about 1/50 to about 1/300;

second baffling means for baffling another flow of the first liquid so as to prevent a sloshing phenomenon caused by resonance of the first liquid to the structure;

moving means, mounted to the first tank, for vertically moving the second baffling means between a raised position and a lowered position at which the second baffling means is in the first liquid; and controlling means for detecting the sloshing phenomenon and then controlling the moving means to lower the second baffling means to the lowered position.

7. A device for suppressing vibration of a structure, comprising:

a first tank, disposed in the structure, for receiving a first liquid for suppressing vibration of the structure, the first tank being adapted to contain such an amount of the first liquid that the first liquid is equal in natural period to the structure, the first tank being adapted to contain such an amount of the first liquid that a ratio of effective means of the first liquid over mass of the structure is about 1/50 to about 1/300, the structure being a building, and the first tank being disposed within the building.

8. A device for suppressing vibration of a structure, comprising:

a first tank, disposed in the structure, for receiving a first liquid for suppressing vibration of the structure, the first tank being adapted to contain such an amount of the first liquid that the first liquid is equal in natural period to the structure, the first tank adapted to contain such an amount of the first liquid that a ratio of effective mass of the first liquid over mass of the structure is about 1/50 to about 1/300, the structure being a bridge having a plurality of towers, each tower having a top, and the first tank being mounted on the top of at least one of the towers.

9. A device for suppressing vibration of a structure, comprising:

a first tank, disposed in the structure, for receiving a first liquid for suppressing vibration of the structure, the first tank being adapted to contain such an amount of the first liquid that the first liquid is equal in natural period to the structure, the first tank being adapted to contain such an amount of the first liquid that a ratio of effective mass of the first liquid over mass of the structure is about 1/50 to about 1/300, the structure being a bridge having a reinforced girder, and the first tank being mounted on the girder.

10. A device for suppressing vibration of a structure, comprising:

a first tank, disposed in the structure, for receiving a first liquid for suppressing vibration of the structure, the first tank being adapted to contain such an amount of the first liquid that the first liquid is equal in natural period to the structure, the first tank being adapted to contain such an amount of the first liquid that a ratio of effective mass of the first liquid over mass of the structure is about 1/50 to about 1/300, the first tank being provided in a plurality.

11. A device as recited in claim 10, further comprising means for supplying and draining the first liquid to control the amount of the first liquid in the first tanks.

12. A device as recited in claim 11, wherein the first tanks are in the shape of a rectilinear close box.

13. A device as recited in claim 12, wherein the first tanks have each a side wall including an inner face, the inner face being provided with an irregularity for increasing resistance of the inner face to the first liquid for adjustment in damping factor.

14. A device as recited in claim 13, wherein the first tanks are portable.

15. A device as recited in claim 14, wherein the first tanks are disposed end-to-end in a columns and rows arrangement.

16. A device as recited in claim 15, wherein each of the first tanks has such a width in an horizontal direction that the first liquid in the tank is equal in natural period to the structure in the horizontal direction.

17. A device for suppressing vibration of a structure, comprising:

a first tank, disposed in the structure, for receiving a first liquid for suppressing vibration of the structure, the first tank being adapted to contain such an amount of the first liquid that the first liquid is equal in natural period to the structure.

the first tank being adapted to contain such an amount of the first liquid that a ratio of effective mass of the first liquid over mass of the structure is about 1/50 to about 1/300;

a second tank; and floating means for floating the second tank on the first liquid in the first tank, the second tank being mounted on the floating means, and the second tank being adapted to contain such an amount of the second liquid that the second liquid is equal in natural period to the first liquid, the ratio of effective mass of the second liquid over mass of the first liquid being about 1/50 to about 1/300.

18. A device for suppressing vibration of a structure, comprising:

a first tank, disposed in the structure, for receiving a first liquid for suppressing vibration of the structure, the structure having a center of rigidity, the first tank being adapted to contain such an amount of the first liquid that the first liquid is equal in natural period to the structure, the first tank having an inner face and first baffling means mounted thereto for baffling a flow of the first liquid so as to suppress the swinging of the structure about the center of rigidity.

19. A device as recited in claim 18 wherein the first tank is in a rectangular parallelepiped form defining a longitudinal direction and a transversal direction and the first liquid has a longitudinal natural period and a transversal natural period in the longitudinal and the transversal directions respectively, which coincide respectively with natural frequencies of the structure in longitudinal and transversal directions.

20. A device as recited in claim 18, wherein the first tank is adapted to contain such an amount of the first liquid that a ratio of effective mass of the first liquid over mass of the structure is about 1/50 to about 1/300.

21. A device as recited in claim 18, wherein the ratio of the effective mass of the first liquid over the mass of the structure is not smaller than about 1/100.

22. A device as recited in claim 19, further comprising a horizontal partition wall horizontally partitioning the first tank to define two chambers, each chamber being adapted to contain such an amount of the first liquid that the first liquid is equal in natural period to the structure.

23. A device as recited in claim 19, further comprising, second baffling means for baffling another flow of the first liquid so as to prevent a sloshing phenomenon caused by resonance of the first liquid to the structure;

moving means, mounted to the first tank, for vertically moving the second baffling means between a raised position and a lowered position at which the second baffling means is in the first liquid; and controlling means for detecting the sloshing phenomenon and then controlling the moving means to lower the second baffling means to the lowered position.

24. A device as recited in claim 18, wherein the structure is a building, and wherein the first tank is disposed within the building.

25. A device as recited in claim 19, wherein the structure is a bridge having a plurality of towers, each tower having a top, and wherein the first tank is mounted on the top of at least one of the towers.

26. A device as recited in claim 19, wherein the structure is a bridge having a reinforced girder, and wherein the first tank is mounted on the girder.

27. A device as recited in claim 19, wherein the first tank is provided in a plurality.

* * * * *